US007665644B2

(12) United States Patent
Hu

(10) Patent No.: US 7,665,644 B2
(45) Date of Patent: Feb. 23, 2010

(54) STAPLER

(76) Inventor: Chih-Wei Hu, 8F.-6, No. 391, Sec. 4, Sinyi Road, Taipei City (TW)

( * ) Notice: Subject to any disclaimer, the term of this patent is extended or adjusted under 35 U.S.C. 154(b) by 0 days.

(21) Appl. No.: 11/956,505

(22) Filed: Dec. 14, 2007

(65) Prior Publication Data

US 2009/0152320 A1 Jun. 18, 2009

(51) Int. Cl.
*B25C 5/11* (2006.01)
*B25C 7/00* (2006.01)

(52) U.S. Cl. ..... 227/132; 227/8; 227/146

(58) Field of Classification Search ..... 227/132, 227/8, 127, 146
See application file for complete search history.

(56) References Cited

U.S. PATENT DOCUMENTS 2,493,640 A * 1/1950 Peterson ..... 227/132
2,603,782 A * 7/1952 Spencer ..... 227/132
2,657,384 A * 11/1953 Boroughs ..... 227/132
3,229,882 A * 1/1966 Abrams ..... 227/132
4,126,260 A * 11/1978 Mickelsson ..... 227/132
5,335,839 A * 8/1994 Fealey ..... 227/132

* cited by examiner

*Primary Examiner*—Rinaldi I. Rada
*Assistant Examiner*—Nathaniel Chukwurah
(74) *Attorney, Agent, or Firm*—Alan Kamrath; Kamrath & Associates PA

(57) ABSTRACT

A stapler has a body including two holes formed on two sidewalls thereof and a first link defined on one sidewall thereof. A magazine is assembly installed in the bottom of the body. A handle assembly includes a handle lever formed on an end thereof and a handle stop defined on another end thereof. A second link and a through hole are between the handle lever and the handle stop. A connector is disposed in the second link and pivotally couples to the two holes, and a first roller is inserted through the through hole and moves rotatably in the first link of the body. A power spring is disposed in the body, and a plunger includes a first hole and a second hole. When the handle lever is pressed downwardly and the handle stop lifts the plunger upwardly, the first roller is driven to move rotatably in the first link of the body to detach the handle stop from the plunger gradually.

8 Claims, 6 Drawing Sheets

STAPLER

BACKGROUND OF THE INVENTION

1. Field of the Invention

The present invention relates to a stapler.

2. Description of the Related Art

Referring to FIG. 6, a known stapler includes a base portion 91, a magazine 92 installed to the bottom of the base portion 91, and a handle portion 93 pivotally coupling to a pivot point (not numbered) of the base portion 91 and being adjustably movable relative to said pivot point. Moreover, an end of the handle portion 93 connects to and drives a plunger 94, and another end of the handle portion 93 is exposed from the base portion 91. A power spring 95 is disposed in the base portion 91 and couples to the plunger 94 so as to limit the handle portion 93.

While the handle portion 93 is pressed downwardly, the plunger 94 is lifted and drives the power spring 95 upwardly. Because of the reaction of the power spring 95, the lower the handle portion 93 is downwardly pressed, the larger the strength forces of the spring 95 to the handle portion 93. However, when the handle portion 93 is pressed to the lowest position, the position of said pivot point is adjustable relative to the handle portion 93 to force the handle portion 93 to detach from the plunger 94. Next, the staple function is done.

The foregoing shows that when the handle portion 93 is pressed to approach the lowest position, the reaction of the power spring 95 is largest. Hence, it's difficult for a user to move the handle portion 93 relative to said pivot point to detach from the plunger 94. Furthermore, the user has to exert a huge force to operate for stapling so that there will be a loud noise. Also, the known stapler is easy to be broken by forcing excessively.

The present invention is therefore intended to obviate or at least alleviate the problems encountered in the prior art.

SUMMARY OF THE INVENTION

The present invention solves this need and other problems in the field of staplers by providing, in a preferred form, a stapler including a body, a magazine assembly installed in the bottom of the body, a handle assembly pivotally coupling to the body, an elongate power spring disposed in the body between the magazine assembly and a handle assembly, a plunger connected to the elongate power spring and the handle assembly, and a buffer device installed on the connection of the elongate power spring and the plunger.

The handle assembly includes a first link, first and second rollers and a connector. The body further includes two holes formed on two sidewalls thereof and respectively corresponding to the first link of the handle assembly. A second link is formed on one of the sidewalls and receives the first roller. The connector is inserted through one hole and the second roller to another hole.

When the handle assembly is pressed downwardly, the pivot position of the second roller with the connector changes for reducing the pressing force. Also, as the handle lever is pressed downwardly and the handle stop lifts the plunger upwardly, the first roller is driven to move rotatably in the first link of the body to detach the handle stop from the plunger gradually.

Other advantages, objectives and features of the present invention will become apparent from the following description referring to the attached drawings.

BRIEF DESCRIPTION OF THE DRAWINGS

The detailed description and technical characteristics of the present invention and described together with the drawings as follows.

DETAILED DESCRIPTION OF THE PREFERRED EMBODIMENT

Figure 1:
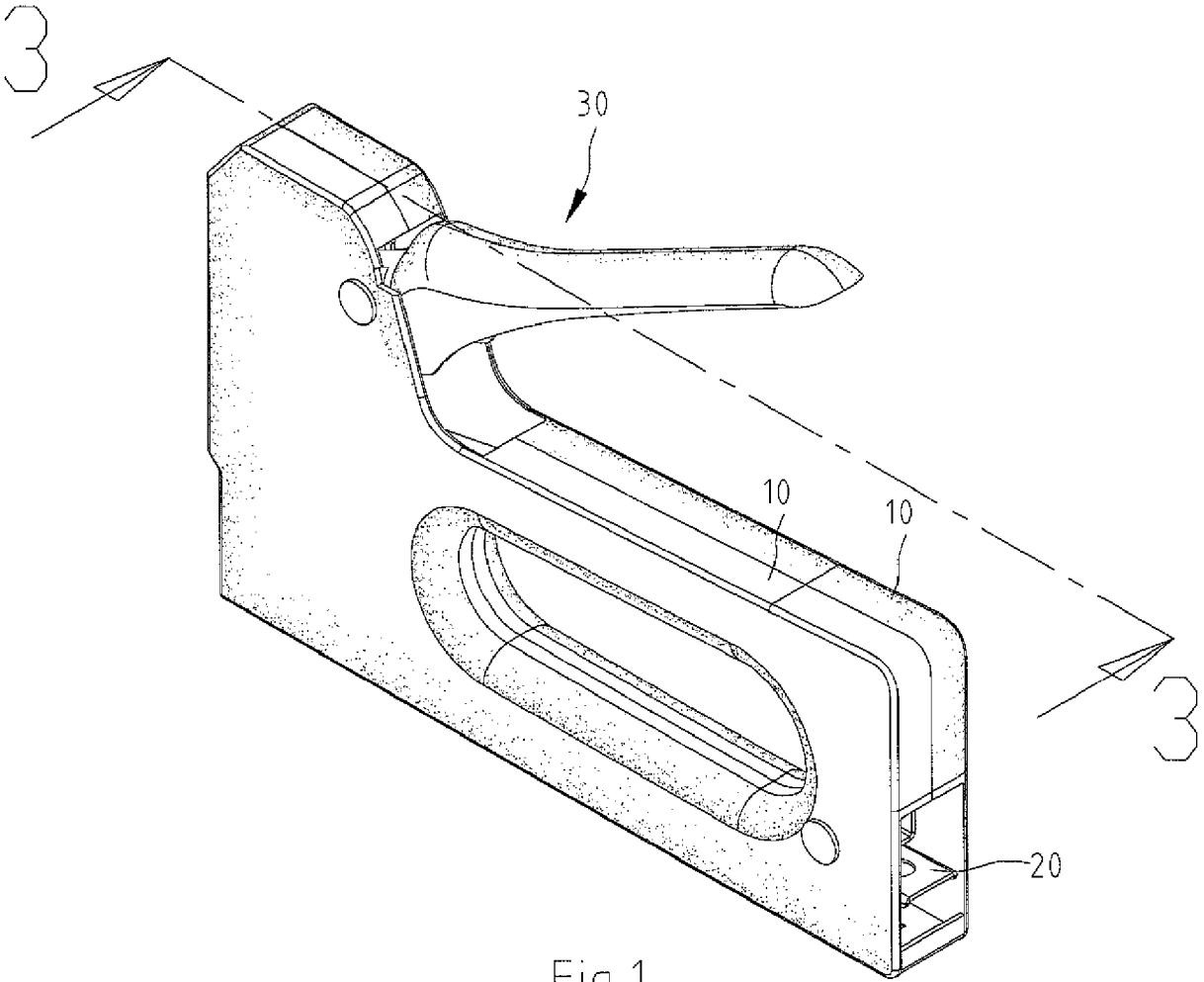
FIG. 1 is a perspective view of a stapler in accordance with the preferred embodiment of the present invention.
Figure 2:
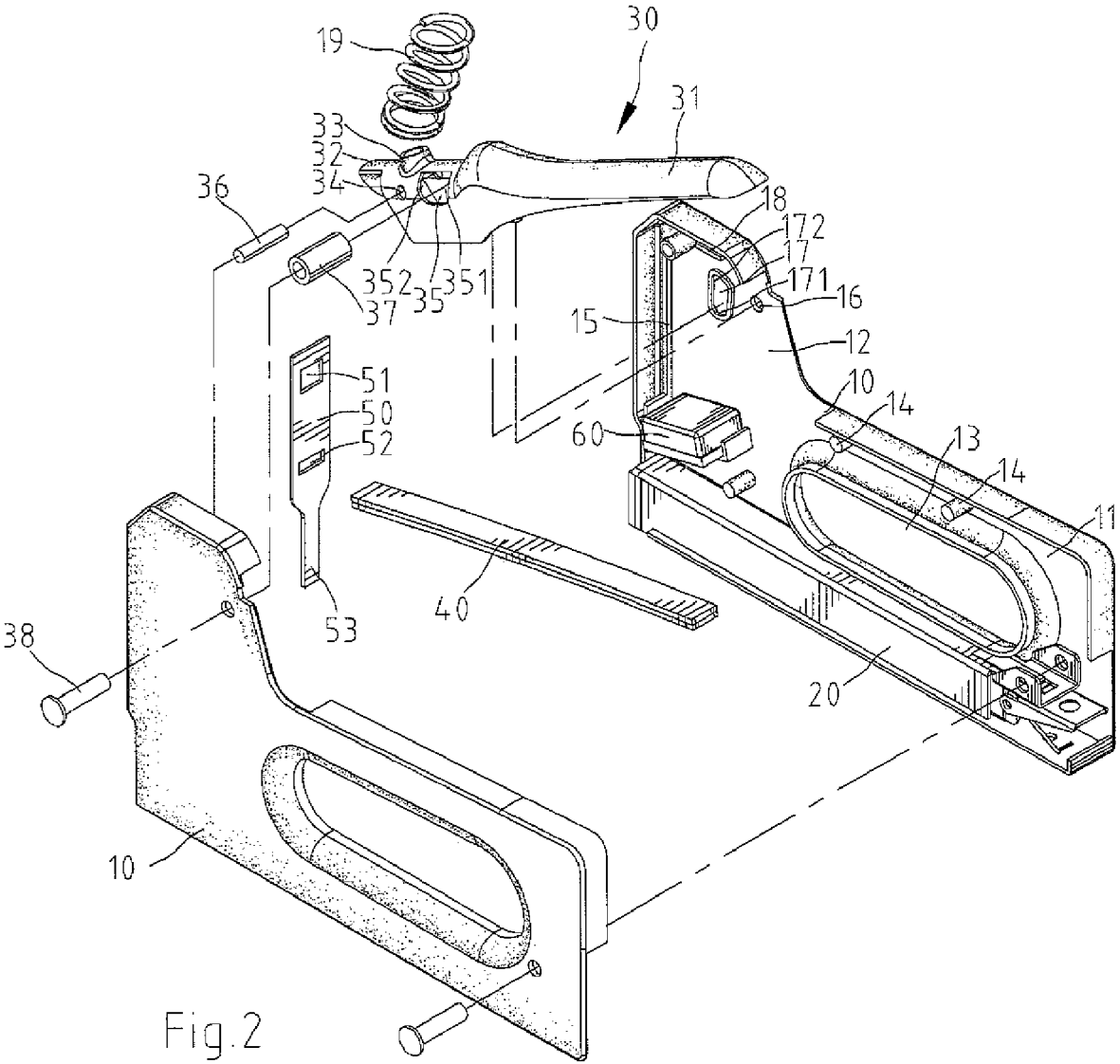
FIG. 2 is an exploded view of a stapler in accordance with the preferred embodiment of the present invention.

Referring to FIGS. 1 and 2, a stapler in accordance with the preferred embodiment in the present invention includes a body 10 that consists of two shell halves. A magazine assembly 20 is disposed in the bottom of the body 10. A handle assembly 30 is pivotally disposed in the body 10. An elongate power spring 40 is provided between the handle assembly 30 and the magazine assembly 20. A plunger 50 is respectively connected to the elongate power spring 40 and the handle assembly 30, and a buffer device 60 is installed adjacent to the connection of the elongate power spring 40 and the plunger 50.

The body 10 includes a base portion 11 and a head portion 12. A holding portion 13 is defined on the base portion 11 and is adapted for a user's hand to grip. Two limited portions 14 are formed between the holding portion 13 and the upper outer periphery of the body 10. The two limited portions 14 are a distance apart. The body 10 further includes a plunger ledge 15 defined adjacent to the front of the head portion 12. Two holes 16 are formed on two sidewalls of the head portion 12, and a first link 17 formed on one of said sidewalls. A spring ledge 18 is provided adjacent to the upper periphery of the head portion 12, and a return spring 19 is mounted on the spring ledge 18.

The first link 17 is defined between the spring ledge 18 and the buffer device 60. Also, the link 17 is defined between the plunger 50 and the holes 16. Moreover, the first link 17 has a first end 171 extending toward the buffer device 60, and two second ends 172 extending toward the spring ledge 18. In addition, the first link 17 can have various profiles.

The handle assembly 30 includes a handle lever 31 formed on an end thereof and a handle stop 32 formed on another end thereof. A spring anchor 33 is defined on the outer periphery of the handle assembly 30 adjacent to the handle stop 32. A though hole 34 and a second link 35 are defined through the handle assembly 30. The return spring 19 is disposed between the spring ledge 18 and the spring anchor 33. A first roller 36 is inserted through the though hole 34 to the first link 17 of the body 10. A second roller 37 is disposed though the second link 35 of the handle assembly 30. A connector 38 is inserted through one hole 16 and the second roller 37 to another hole 16 as to fix two halves of the body 10 to one another. Moreover, the second link 35 of the handle assembly 30 includes a first end 351 adjacent to the handle lever 31 and a second end 352 adjacent to the handle stop 32.

An end of the elongate power spring 40 is placed above the two limited portions 14, and another end of the elongate power spring 40 is inserted in the plunger 50.

The space that is defined between the plunger ledge 15 and the periphery of the body 10 is adapted to receive the plunger 50. Therefore, the plunger 50 is limited not to move transversely and only moves longitudinally on the plunger ledge 15. The plunger 50 includes a first hole 51 and a second hole 52 formed thereon, and a firing portion 53 is defined on the distal end of the plunger 50. The handle stop 32 of the handle assembly 30 is inserted in the first hole 51. The second hole 52 is adapted for the elongate power spring 40 to be inserted therein.

Figure 3:
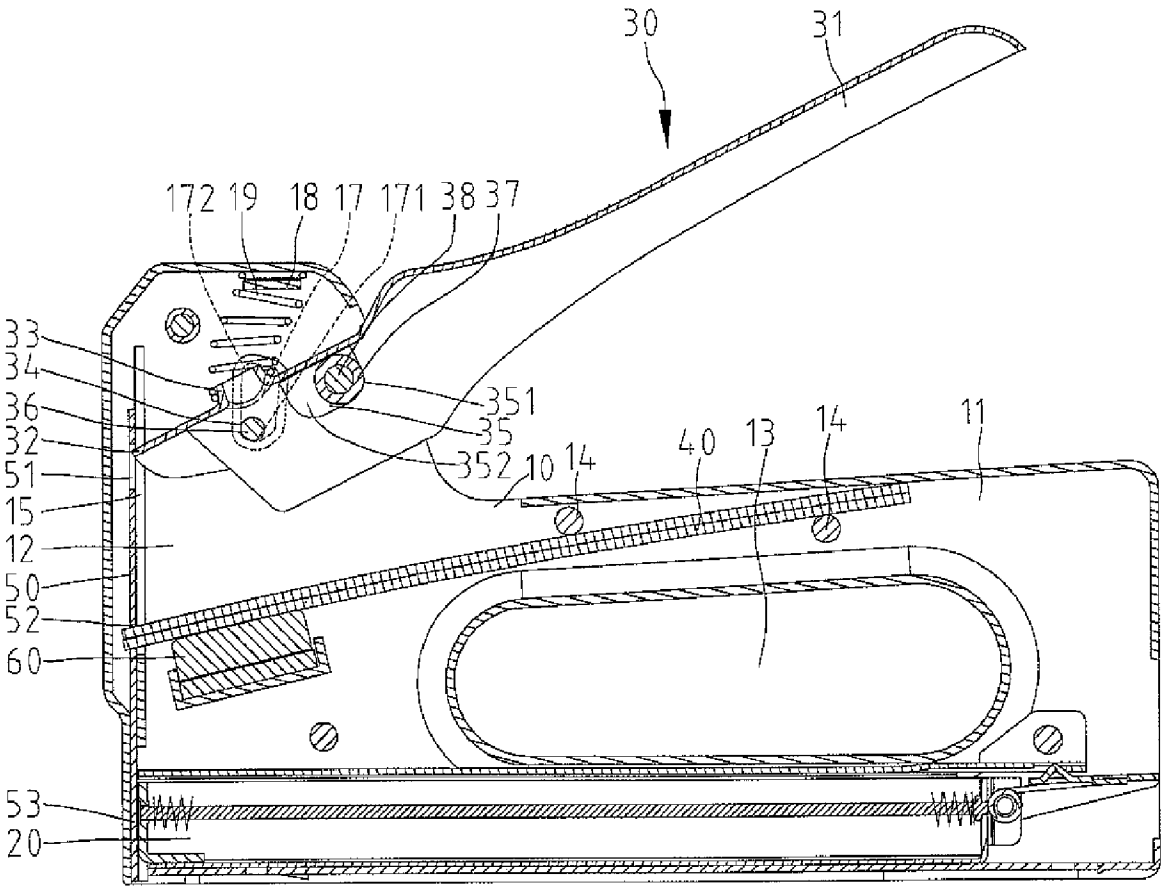
FIG. 3 is a sectional view taken along plane 3-3 in FIG. 1.
Figure 4:
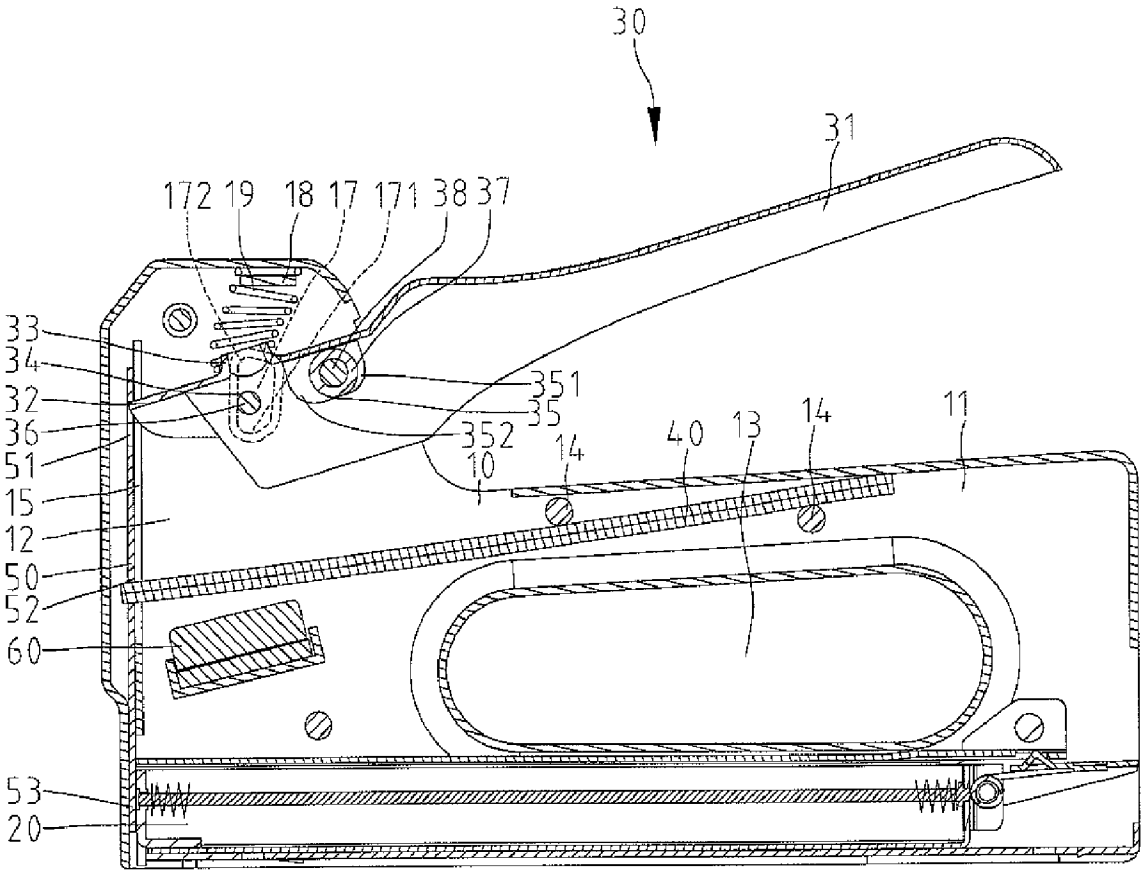
FIG. 4 is a sectional view similar to FIG. 3, illustrating the handle assembly detaching from the plunger gradually.
Figure 5:
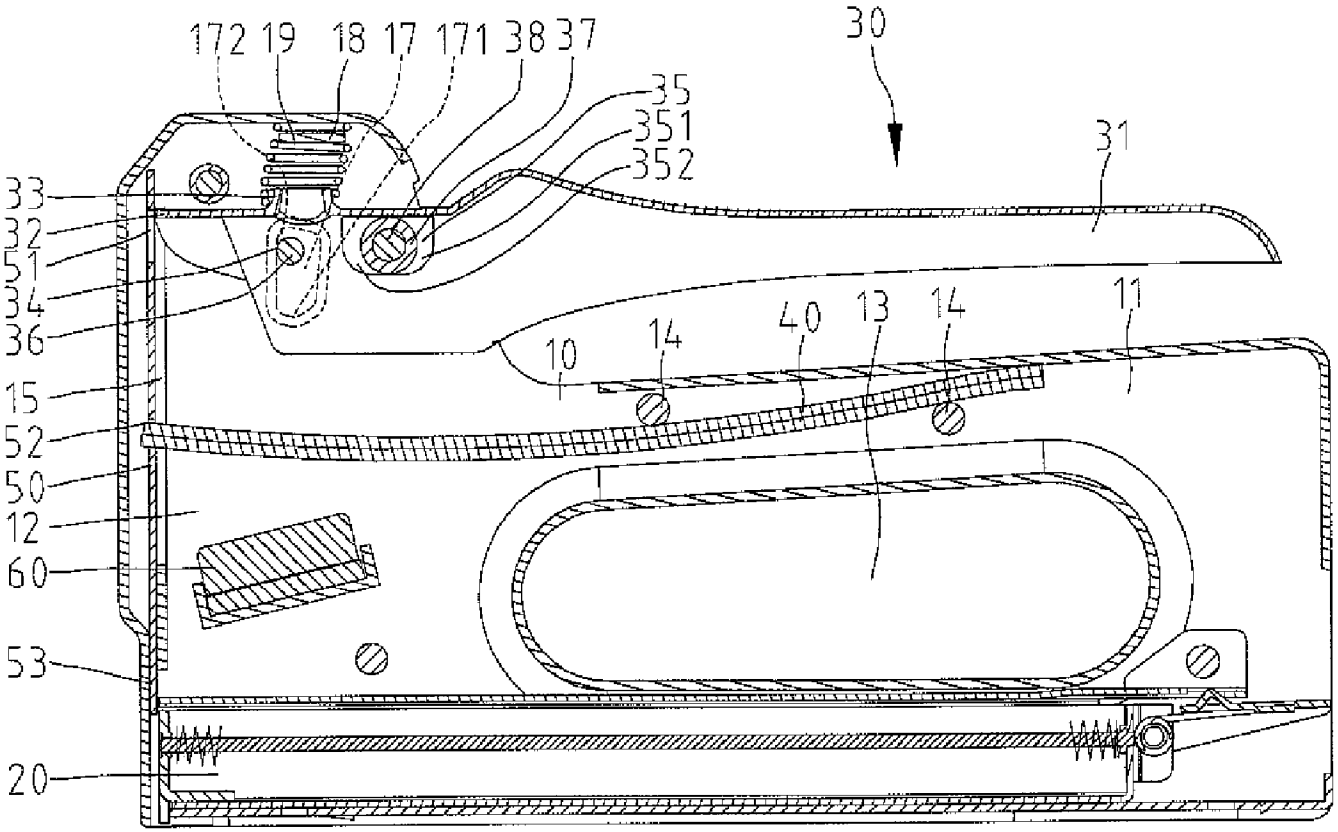
FIG. 5 is a sectional view similar to FIG. 4, illustrating the handle assembly detached from the plunger.
Figure 6:
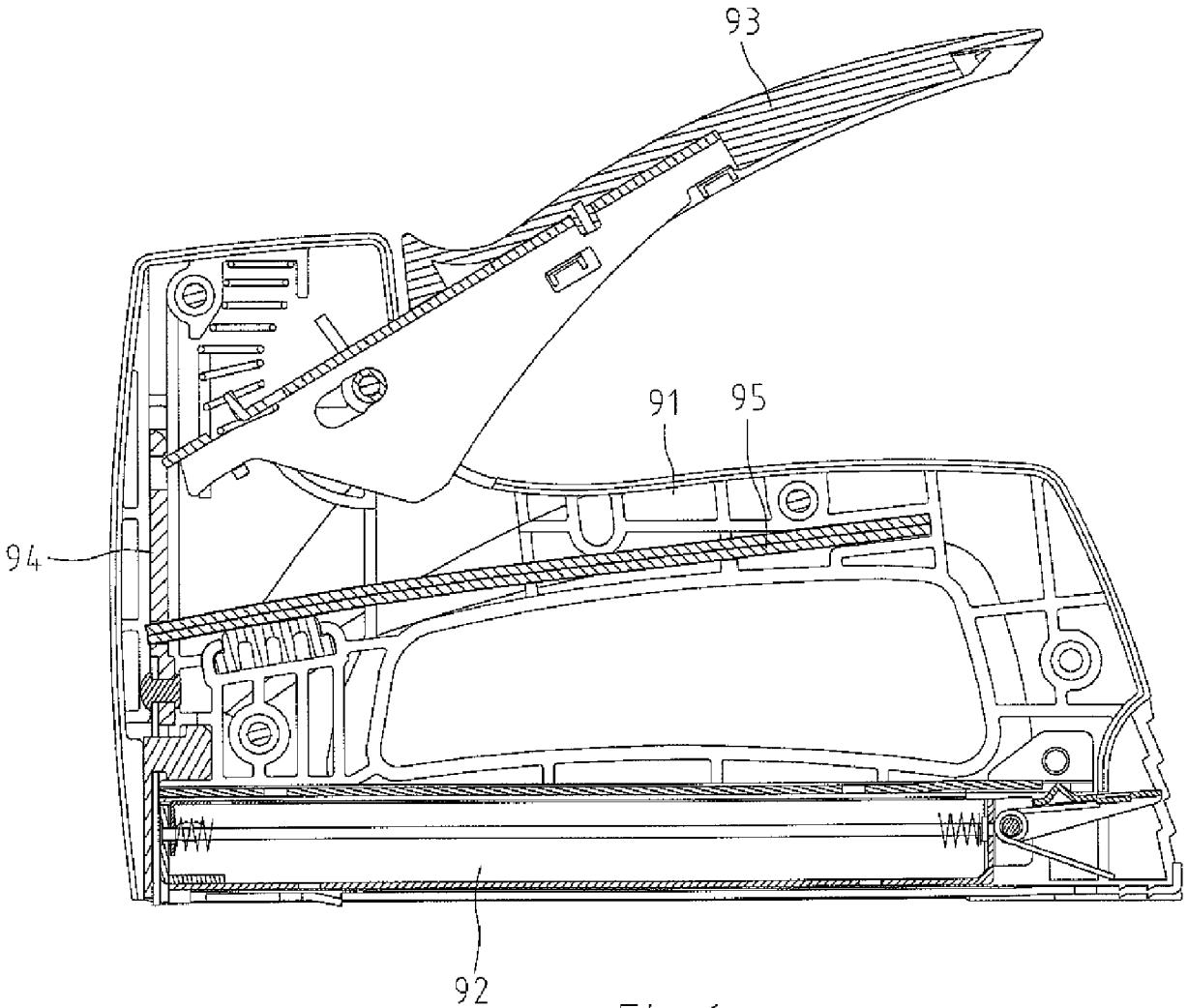
Fig 6 PRIOR ART
FIG. 6 is a perspective view of a known stapler.

Referring to FIGS. 3 to 5, in operation, the user grips on the holding portion 13 of the body 10 and presses the handle lever 31 of the handle assembly 30, and the handle assembly 30 pivots with respect to the second roller 37 and the connector 38 for driving the plunger 50 to staple. When the handle lever 31 is in the highest position, the second roller 37 with the connector 38 are located on the first end 351 of the second link 35, and the first roller 36 is located on the first end 171 of the first link 17.

When pressing the handle lever 31, the second roller 37 with the connector 38 move toward the second end 352 of the link 35 gradually, and the first roller 36 rotates toward the second end 172 along the inner periphery of the first link 17.

When the handle lever 31 is pressed downwardly, the handle stop 32 is lifted upwardly to detach the handle stop 32 from the first hole 51 of the plunger 50 gradually. However, while the handle lever 31 is pressed to the lowest position, the handle stop 32 detaches from the first hole 51 of the plunger 50 completely. Simultaneously, the plunger 50 is driven to dump via the released elongate power spring 40 for stapling. Moreover, the buffer device 60 is provided to block the elongate power spring 40 falling downwardly for preventing the elongate power spring 40 from hitting the body 10 of the stapler so that it can reduce the noise during stapling.

At last, the stapling function is done, the handle assembly 311) is free, and the return spring 19 is released for returning the handle assembly 30 to the original position.

While pressing the handle assembly 30, the handle lever 31 pivots on the second roller 37 with the connector 38 as a pivot point which is changeable. The torque arm increases as a result of the second roller 37 moving toward the handle stop 32. Therefore, it reduces the force for exerting to staple and achieves a purpose of saving-strength. In the meantime, the first roller 36 moves along the inner periphery of the link 17 of the body 10 from the first end 171 to the second end 172. The first roller 36 moves with the handle lever 31 and drives the handle stop 32 to move out of the first hole 51 of the plunger 50 little by little. Thus, when the handle lever 31 is pressed downwardly, the handle stop 32 detaches from the plunger 50 gradually. The handle stop 32 of the handle assembly 30 detaches from the plunger 50 before the handle stop 32 is in the highest position. Thus, the plunger 50 falls down stably to fire nails.

In addition, the handle assembly 30 gradually detaches from the plunger 50, and the plunger 50 does not hit in the body 10 with violence, hence reducing the waste of parts of the stapler and increasing the use-life.

What is claimed is:

1. A stapler comprising:

a body including two holes formed on two sidewalls thereof and a first link defined on one sidewall thereof with the first link having a first end and a second end;

a magazine assembly installed in a bottom of the body;

a handle assembly including a handle lever formed on an end thereof, a handle stop defined on another end thereof, a second link and a through hole between the handle lever and the handle stop, with the second link of the handle assembly having a first end and a second end;

a connector disposed in the second link of the handle assembly and respectively pivotally coupling to the two holes of the body, with the connector moving between the first and second ends in the second link of the handle assembly when pressing the handle lever downwardly;

a first roller inserted through the through hole of the handle assembly and moving rotatably in the first link of the body with the first roller moving between the first and second ends of the first link of the body when pressing the handle lever downwardly, with the second end of the second link located intermediate the first and second ends of the first link of the body, with the first end of the second link being spaced from the first link of the body greater than the second end of the second link;

a power leaf spring disposed in the body and having an end; and a plunger including a first hole and a second hole;

with the handle stop of the handle assembly inserted in the first hole, and with the end of the power leaf spring inserted in the second hole;

wherein while the handle lever is pressed downwardly and the handle stop lifts the plunger upwardly, the first roller is driven to move rotatably in the link of the body as to detach the handle stop from the first hole of the plunger gradually.

2. The stapler as claimed in claim 1, further comprising a second roller, with the connector inserted through one of the two holes of the body and the second roller inserted through another of the two holes of the body.

3. The stapler as claimed in claim 1, further comprising a return spring between the body and the handle stop.

4. The stapler as claimed in claim 3, wherein the handle assembly includes a spring anchor, and the body includes a spring ledge; with the return spring limited between the spring anchor and the spring ledge.

5. The stapler as claimed in claim 1, further comprising a buffer device disposed in a connection of the plunger and the power leaf spring.

6. The stapler as claimed in claim 1, with the first link of the body defined between the two holes and the plunger.

7. The stapler as claimed in claim 1, further comprising a second roller receiving the connector.

8. The stapler as claimed in claim 1 wherein the second link and the though hole of the handle assembly are in a fixed position relative to each other while the handle lever is pressed downwardly.

* * * * *